United States Patent [19]

Gordon, Jr. et al.

[11] 4,366,025

[45] Dec. 28, 1982

[54] SUCTION PRESS ROLL

[75] Inventors: Ambrose L. Gordon, Jr., South Beloit; Leroy H. Busker, Rockton, both of Ill.

[73] Assignee: Beloit Corporation, Beloit, Wis.

[21] Appl. No.: 270,364

[22] Filed: Jun. 4, 1981

[51] Int. Cl.[3] ..... D21F 3/08

[52] U.S. Cl. ..... 162/358; 29/121.1; 29/121.3; 100/118; 100/121; 162/372

[58] Field of Search ..... 162/358, 368, 369, 372; 29/121.1, 121.3; 100/118, 121

[56] References Cited

U.S. PATENT DOCUMENTS

| | | | |
|---|---|---|---|
| 1,596,775 | 8/1926 | Stephansen | 162/368 |
| 3,023,805 | 3/1962 | Walker | 162/358 |
| 3,562,883 | 2/1971 | Kobayashi | 162/372 |
| 3,826,713 | 7/1974 | Nykopp | 162/358 |

OTHER PUBLICATIONS

"Wet-Press Water Removal Over a Wide Parameter Range", L. H. Busker, Paper Technology and Industry, Apr. 1980.

"Practical Limitations to Water Removal at the Presses", C. A. Warren, Paper Technology and Industry, Sep. 1976.

"How Important is Rewetting in Wet Pressing", Wm. C. Bliesner and M. A. MacGregor, TAPPI, vol. 59, No. 6, Jun. 1976.

"Duplication of Pilot Pressing Studies Using a Laboratory Web Former", Michael L. MacGregor, TAPPI, vol. 58, No. 6, Jun. 1975.

"Felt Designs Improved by Use of Microphotography Technique", Pulp & Paper, Feb. 1975.

"The Vented-Nip Press", E. J. Justus and Dennis Cronin, TAPPI, Aug. 1964, vol. 47, No. 8.

*Primary Examiner*—Peter Chin

*Attorney, Agent, or Firm*—Hill, Van Santen, Steadman, Chiara & Simpson

[57] ABSTRACT

A press roll for a press couple for dewatering a web in a papermaking machine wherein the roll preferably is a roll shell with certain of the drilled holes extending radially fully through the shell and certain other holes blind drilled to extend only a partial way into the shell and in one form, the shell having a rubber cover and the blind drilled holes extending alternate different depths to avoid shear planes in the rubber cover.

8 Claims, 5 Drawing Figures

Fig. 1
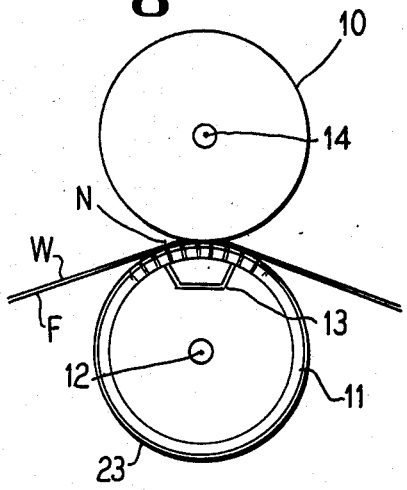
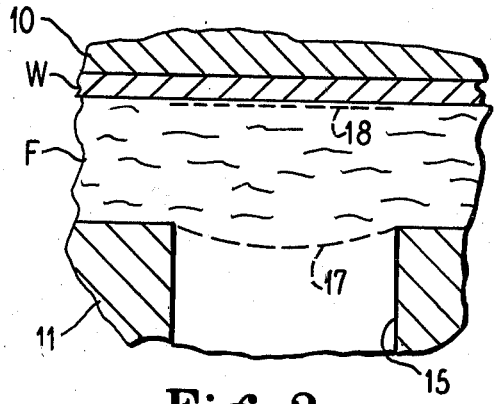
Fig 2
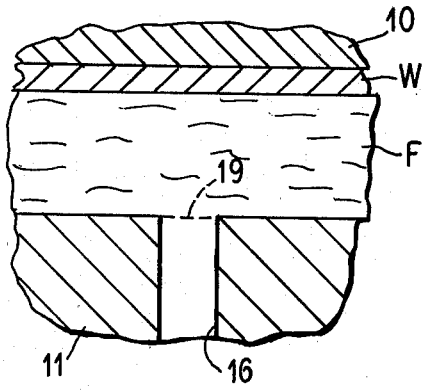
Fig. 3
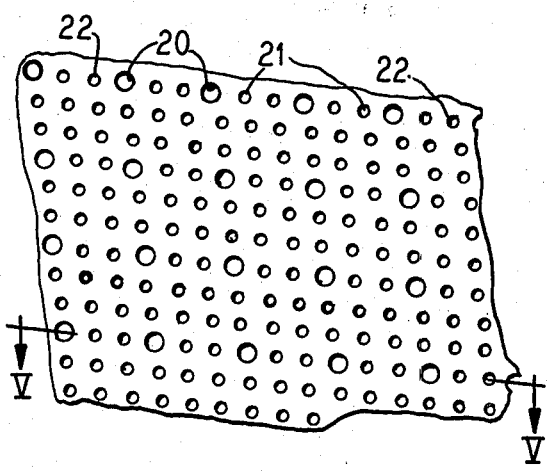
Fig. 4
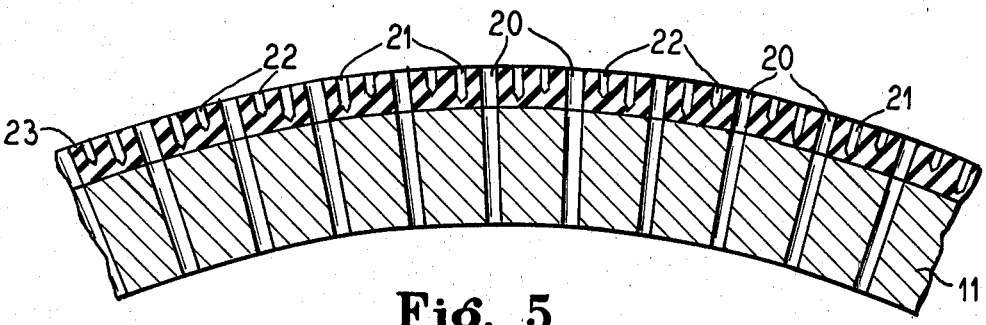
Fig. 5

SUCTION PRESS ROLL

BACKGROUND OF THE INVENTION

The invention relates to improvements in paper machine press rolls, and more particularly to an improved press roll with a drilled hole pattern in the surface that attains improved dewatering of a web passing through a press couple formed between two press rolls.

The invention relates to a press roll primarily as used in a press couple where opposed parallel rolls pass a felt and a web therebetween to press water from the web into the felt. The roll backing the felt may be provided with various configurations to relieve the resistance to water flow and accept water being pressed into and through the felt. If no such means are provided, the roll is generally referred to as a plain roll, but the rolls with relieving openings are grooved rolls, blind drilled rolls, fabric sleeve rolls and suction rolls. While such rolls are presently currently used in roll couples, they may also be employed in extended nip presses where one side of the nip is faced by an arcuate shoe or belt creating a pressing zone against the surface of the roll.

A requirement of a roll in a dewatering press is that it function to transfer the maximum amount of water from a web to a felt passing through the nip, and this is accomplished by offering a minimum amount of resistance to the transfer of water. This must be done uniformly so as not to mark the web, and must be done with a minimum amount of rewetting on the offrunning side of the nip.

THE INVENTION

An object of the invention is to provide an improved press roll structure and particularly an open roll which enhances the removal of water from a web in the press nip, and which eliminates or substantially reduces the marking of the web.

Where an open roll is used with grooves or drilled holes in the surface, it has been thought by some that the water flow path length is of primary importance in determining water removal. This has been found to be a factor, but an important factor has been discovered to be the uniformity of pressure in the press nip. Such uniformity will not be accomplished if the drilled holes in the roll are too large so that the bridging distance over the holes permits the felt to be depressed into the hole thereby reducing the pressure applied to the web. Tests have shown that with low ingoing felt moisture, the plain press, the fabric sleeve press and the grooved press all perform about the same level. The blind drilled roll and suction roll do not give as good a performance, and this is believed to be due to a poorer pressure uniformity due to the large size of holes or vents in rolls with conventional structures, that is, with conventional size holes or vents and with a conventional distribution of holes or vents. While it is important to keep the flow path length short, it is equally important to keep the bridging distance short, that is, the distance across the hole opening.

It is generally not practical to drill a hole 2" to 3" deep which is necessary through a roll shell when the hole diameter is below 0.1". No practical manufacturing technique has been discovered for drilling deep small diameter holes so that it would be impractical to reduce the hole size in a suction roll in order to place the holes closer together to attain sufficient open area.

A feature of the invention is to provide a roll shell with holes of a conventional size extending all the way through the shell in a conventional suction roll manner, and to intersperse between the suction holes blind drilled holes. A further feature of the invention is to provide the blind drilled holes of varying depths, particularly in rubber covered rolls to avoid shear planes in the rubber cover. A further object of the invention is to provide a hole pattern as above described which reduces the noise generation occurring at high operating speeds.

A further object of the invention is to provide a press roll with holes or openings in the surface which are sufficiently small to reduce the bridging distance and obtain uniform pressure on the web and yet which are not so small that they will encounter plugging or filling from the material of the felt.

Other objects and advantages and features will become more apparent with the teaching of the principles of the invention in connection with the disclosure of the preferred embodiments in the specification, claims and drawings, in which:

DRAWINGS

FIG. 1 is a somewhat schematic elevational view of a roll press couple for dewatering a web in a paper machine;

FIG. 2 is an enlarged sectional view illustrating the effect of an opening in the roll shell on the felt;

FIG. 3 is a view similar to FIG. 2 illustrating a smaller opening in the roll shell;

FIG. 4 is a plan view of a portion of a roll shell surface constructed in accordance with the principles of the present invention; and FIG. 5 is a fragmentary sectional view taken substantially along line V—V of FIG. 4.

DESCRIPTION OF THE PREFERRED EMBODIMENTS

FIG. 1 illustrates a roll couple with a wet paper web W supported on a felt F passing through the nip N. The nip is formed between an upper plain roll 10 suitably supported for rotation on an axis 14, and a lower roll shell 11 suitably supported for rotation on an axis 12. Within the roll shell and opposite the nip N is a suction gland 13.

As the web W is carried through the nip, it is subjected to the pressure between the two rolls and water is expressed out of the web into the felt and into openings in the surface of the roll shell 11. The openings are to permit water to pass easily into the felt from the paper and to receive water from the felt. In considerations of having larger open areas for the passage of water and for reducing the distance the water must travel, it has been discovered that reduced water transfer occurs with increased size of openings, and as illustrated in FIG. 2, at the bridging area of an opening 15, the felt F is unsupported. As illustrated at 17, where the opening in the suction roll has a dimension D, the felt tends to sag downwardly into the opening so that it is unsupported resulting in a low pressure area 18 opposite the web W. At this low pressure area, less water is pressed from the web so that despite a larger open area, not as much water travels out of the web into the felt and into the opening.

With a shorter bridging area 19 as illustrated in FIG. 3, as results from a smaller opening 16 in the roll 11, there is no low pressure area because the diameter of the opening 16 is small enough that the felt does not sag into the opening. This results in uniform pressure being applied to the web W even opposite the openings. Yet, as discussed above, it is impossible by known rechniques to drill small openings of sufficient number through the approximate 3" thickness of the roll shell.

In accordance with the concepts of the present invention, blind drilled holes are interspersed between the suction roll holes. As illustrated in FIGS. 4 and 5, holes 20 extend all the way through the roll shell. Between these are blind drilled holes 21 and 22 which can be of smaller diameter because they are not drilled all the way through the shell. Structurally, the blind drilled holes preferably extend only into the hard rubber cover 23 that forms the outer layer of the suction roll shell 11.

To avoid a shear plane being formed in the cover, the blind drilled holes 21 and 22 are drilled of different depths. From a structure standpoint, the roll shell has a plurality of holes in the surface leading to axially extending passages which are of different lengths. The passages formed at 20 extend all the way through the roll shell. The passages 21 are blind drilled of maximum depth. The passages 22 are shallower blind drilled openings.

Further, the blind drilled holes are preferably of smaller diameter, on the order of 0.02" to 0.1" in diameter. The shallower holes 22 are ¼" deep, and the deeper holes 21 are ⅜" deep.

With the arrangement, the suction holes 20 are drilled at a spacing somewhat greater than currently used, i.e., 1.5 to 5 times the usual distance apart. This reduces the total area where low support is given in the manner illustrated in FIG. 2. Some vacuum will still exist at the shell surface to effect control over sheet transfer or direction, and to aid in water transfer. The blind drilled holes in combination with the suction holes attain a greater frequency over a shorter distance between holes than possible with the normal suction roll pattern where all of the holes are through drilled holes. The arrangement attains a better transfer of water into the felt and into the holes than where all through drilled holes are used because of the more uniform pressure applied to the web. This is caused by a smaller bridging area for the blind drilled holes, and yet accomplishing a greater number of openings within a given area. The hole distribution is such that the total open area on the roll face is 20% to 25% of the area.

As illustrated in FIG. 4, a preferred form of hole pattern is such that there are two blind drilled holes between every pair of through holes. One of these blind drilled holes is shallower than the other eliminating the shear plane.

The through holes 22 are of a commercially acceptable size on the order of 0.109" in diameter.

In operation, with reference to FIG. 1, the web and felt pass through the nip and dewatering occurs with a uniform pressure being applied to the web through the nip. Water passes into the felt and into the open holes 20 and blind drilled holes 21 and 22, and is thrown off on the offrunning side, and the felt is dried. A more uniform and better transfer of water occurs than with conventional suction roll drilling patterns with all through drilled holes or with the other forms of roll openings including conventional blind drilled openings, grooved rolls or fabric sleeve covers.

Thus, it will be seen that we have provided an improved press roll structure which accomplishes advantages and objectives above set forth, and we do not intend to be limited to the specific form of invention disclosed, but intend to cover all equivalents and modifications thereof.

We claim as our invention:

1. In a press couple for dewatering a traveling web in a papermaking machine, the combination comprising:

first and second press means defining a press nip therebetween with said second means being a cylindrical press roll shell;

water receiving means for passing through said nip in contact with the roll and carrying a traveling paper web through the nip; and means defining a plurality of holes in the roll surface accommodating travel of water from the web through the water receiving means, said holes including a first group extending axially fully through the shell and a second group of holes being more shallow than the first holes and having a closed inner end.

2. In a press couple for dewatering a traveling web in a papermaking machine constructed in accordance with claim 1 and including:

said water receiving means being a felt.

3. In a press couple for dewatering a traveling web in a papermaking machine constructed in accordance with claim 1 and including:

said first and second holes being alternately positioned on the roll surface.

4. In a press couple for dewatering a traveling web in a papermaking machine constructed in accordance with claim 3:

wherein the depth of the first group is substantially ¼" and the second group substantially ⅜".

5. A structure for dewatering a web in a paper machine having a first and second press means defining a press nip, one of said press means comprising:

a rotatable press roll shell having rotary support means and a cylindrical outer shell surface;

and means defining a plurality of holes in the surface of the roll for receiving water expressed from a web adjacent the roll surface subject to pressure, a first group of said holes extending radially fully through the shell and a second group of said holes extending only a portion of the way through said shell.

6. A structure for dewatering a web in a paper machine constructed in accordance with claim 5:

wherein said shell has an outer cover of resilient material and said second group of holes are of a depth no greater than the depth of said resilient cover.

7. A structure for dewatering a web in a paper machine constructed in accordance with claim 5:

wherein said holes include a third group of a depth less than said second group.

8. A structure for dewatering a web in a paper machine constructed in accordance with claim 7:

wherein said first group has a diameter in the range of 0.1 to 0.15", and said second and third groups have a diameter in the range of 0.02 to 0.1".

* * * * *